US008113094B1

(12) United States Patent
Brackbill et al.

(10) Patent No.: US 8,113,094 B1
(45) Date of Patent: Feb. 14, 2012

(54) EMERGENCY RESPONDER RESCUE TOOL

(75) Inventors: Brian D. Brackbill, Saratoga, CA (US); Robert B. Brackbill, Port Angeles, WA (US)

(73) Assignee: Tug Rescue Tool Company, LLC, Port Angeles, WA (US)

( * ) Notice: Subject to any disclaimer, the term of this patent is extended or adjusted under 35 U.S.C. 154(b) by 291 days.

(21) Appl. No.: 12/592,667

(22) Filed: Nov. 30, 2009

Related U.S. Application Data

(63) Continuation-in-part of application No. 11/682,593, filed on Mar. 6, 2007, now abandoned.

(51) Int. Cl.
*B25B 13/00* (2006.01)

(52) U.S. Cl. ..... 81/138; 81/125.1; 81/176.1; 81/463; 7/138; 7/140

(58) Field of Classification Search ..... 81/125.1, 81/138, 176.1, 463; 7/138, 140
See application file for complete search history.

(56) References Cited

U.S. PATENT DOCUMENTS

| | | | | | |
|---|---|---|---|---|---|
| 579,748 | A | * | 3/1897 | Haley | 7/138 |
| 1,527,772 | A | * | 2/1925 | Baird | 81/176.1 |
| 1,703,856 | A | * | 2/1929 | McKeag | 7/138 |
| 3,705,430 | A | | 12/1972 | Ziaylek, Jr. | |
| D244,252 | S | * | 5/1977 | Ardis | D8/26 |
| 4,207,675 | A | * | 6/1980 | Causey et al. | 30/296.1 |
| 5,943,778 | A | * | 8/1999 | Alana | 30/101 |
| 6,308,355 | B1 | * | 10/2001 | McMillan et al. | 7/142 |
| 6,447,033 | B1 | * | 9/2002 | Konczak | 294/15 |
| 6,899,001 | B1 | * | 5/2005 | Sanders et al. | 81/176.3 |
| D566,494 | S | | 4/2008 | Karl | |

* cited by examiner

*Primary Examiner* — Robert Scruggs
(74) *Attorney, Agent, or Firm* — Virginia P. Shogren

(57) ABSTRACT

A multipurpose rescue tool comprising a unitary metallic sheet member of a uniform diameter having an L-shaped hook portion, a grip portion with U-shaped finger guard, and a flared base portion. The head of the hook portion has pivot notches formed within the peripheral edge, a first end tapered to an acute tip, and a second end comprising a spanner wrench opening. The base portion includes opposed V-shaped flanges for improved grip and a gas valve shut-off aperture. Balanced weight distribution, size and overall tool weight render it capable of storage and transport within a responder's turnouts for efficient use regardless of hand size or strength, in striking, peeling, screw driver, hammer, pry bar, spanner-wrench and valve stem applications.

14 Claims, 6 Drawing Sheets

EMERGENCY RESPONDER RESCUE TOOL

CROSS-REFERENCE TO RELATED APPLICATION

This is a Continuation-In-Part Application claiming priority under 35 USC 120 of U.S. patent application Ser. No. 11/682,593 filed Mar. 6, 2007 now abandoned entitled "Fireman's Rescue Tool".

FIELD OF THE INVENTION

This invention relates generally to rescue tool devices, and more particularly to a unitary member all-metallic multipurpose rescue tool that meets the needs of both male and female responders with regard to size, weight, weight distribution, striking power, application to multiple rescue activities, simplicity, transport, storage, hand protection, and maximized leverage.

BACKGROUND OF THE INVENTION

Emergency responders face situations in which they must act immediately and without hesitation to save a life, including their own. One example is vehicle rescue and extrication of accident victims. Emergency responders often have little time to get accident victims free of their vehicles. If the vehicle is on fire, time is of the essence in removing the vehicle occupants and getting both the occupants and the emergency responder away from the vehicle. In such emergency situations, there is no time to adjust tools, no time to return to an emergency responder's vehicle to obtain different tools, and no time to search for different tools to serve different tasks. In addition, adrenaline causes the emergency responder to move quickly and use his/her full force on tools with a corresponding desire by the user for the tool to perform the desired task without hesitation.

Some rescue tools provide advantages while simultaneously creating potential hazards to both the victims and the emergency responders. Examples include pneumatic and hydraulic tools used for cutting metal, prying doors open and otherwise separating objects in order to rescue trapped victims. The hydraulic tools are extremely powerful but are non-discriminating in their reach and effect. In the case of vehicle extrications, rescuers using hydraulic tools have been known to accidentally puncture the highly pressurized gas cylinders that contain gas to fill airbags. The release of gases under pressure through a small puncture opening causes the cylinder to explode and fragment. The cylinder fragments are capable of severely injuring and/or killing the accident victim and/or emergency responder working in close proximity to the accident victim.

Smaller, hand-held rescue tools have been developed to provide more discriminating control over the rescue efforts. However, these tools exhibit one or more drawbacks that make them unsuitable for true emergency work. The drawbacks include: 1) tools with multiple and/or moving (hinged) parts that can break or require time to adjust prior to use; 2) tools of insufficient strength for the task at hand; 3) tools designed for male emergency responders that are not universal for use by female emergency responders in their size, weight, or the strength required to use them; 4) tools that are not designed for the purpose of extrication or capable of fine use such as in pulling material lining away from a vehicle frame to expose the pressurized gas cylinders for avoidance with stronger, pneumatic or hydraulic rescue power tools; 5) tools with insufficient weight distribution to perform the desired task, such as insufficient weight of a striking tool to break otherwise intact car windows for accident victim extrication; 6) tools that lack multipurpose features for other emergency responder tasks, such as connecting fire hoses, turning gas valves of varying sizes/designs off to prevent fire, or turning oxygen tank valves for emergency responder oxygen inhalation systems; 7) tools that are easily damaged in emergency situations through brute force being applied by a user acting with adrenaline, or through physical damage caused by exposure to high heat, hazardous or corrosive liquids; 8) tools that cannot be easily or comfortably carried and accessed by the emergency responder as he/she moves quickly in and around the accident site; 9) tools that provide little to no finger protection to the user; 10) tools that are not designed for handling by a user wearing thick heavy gloves; and, 11) tools that are not designed to provide maximum leverage for when maximum leverage is required to save a life.

Accordingly, there is an as of yet unmet need in the art for a rescue tool for use by emergency responders that: 1) has no moving (hinged) parts or any subparts that can break or require time to adjust prior to use; 2) is constructed in a manner that renders it sufficiently strong for the task at hand; 3) is universally designed for use by both male and female responders regardless of hand size or strength; 4) is capable of fine motor controlled use such as in pulling material lining away from a vehicle frame to expose the pressurized gas cylinders to avoid puncturing same; 5) is designed to have a weight distribution that serves one or more functions such as striking and breaking otherwise intact car windows; 6) has multipurpose features beyond accident victim extrication such as use for connecting fire hoses, turning gas valves of varying sizes/designs off to prevent fire, or turning oxygen tank valves for emergency responder oxygen inhalation systems; 7) is durable and can withstand exposure to high heat, hazardous or corrosive liquids; 8) can be easily and comfortably carried and accessed by the emergency responder as he/she moves quickly in and around the accident site; 9) provides finger protection to the user; 10) is designed for ease of handling by a user wearing thick heavy gloves; and, 11) is designed to provide maximum leverage for maximum strength in emergency situations.

THE INVENTION

Summary of the Invention

The inventive Emergency Responder Rescue Tool comprises a unitary metallic sheet member of a uniform diameter having a top side, a bottom side, a vertical axis, a horizontal axis, and a continuous peripheral edge defining a hook portion at a distal end, a base portion at a proximal end, and a grip portion between the hook and base portions.

The hook portion comprises a head and a neck shaped to form a generally L-shaped hook portion. A first end of the head is generally tapered along its axis to an acute tip, and a plurality of pivot notches are formed in the peripheral edge proximate the acute tip. A second, opposed end of said head has a generally rectangular peripheral edge defining, at a base of said end, a curved spanner wrench opening.

The grip portion includes a finger region opposed to a palm region. The finger region includes at least one opening defined by a continuous generally U-shaped first finger guard extending along the horizontal axis beneath the head of the hook portion. The palm region opposed to the finger guard is defined by a generally convex curve extending along the horizontal axis.

The base portion includes an elongated aperture defined within the unitary sheet member, a lower finger grip region, and a proximal end having opposed left and right V-shaped flanges extending laterally therefrom.

BRIEF DESCRIPTION OF THE DRAWINGS

The invention is described in more detail with reference to the attached drawings, in which.

DETAILED DESCRIPTION OF THE ILLUSTRATIVE EMBODIMENT

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the diagrams show in schematic, or omit, parts that are not essential in that diagram to a description of a particular feature, aspect or principle of the invention being disclosed. Thus, the best mode embodiment of one feature may be shown in one diagram, and the best mode of another feature will be called out in another diagram.

Emergency Responder Rescue Tool

Figures 1, 2:
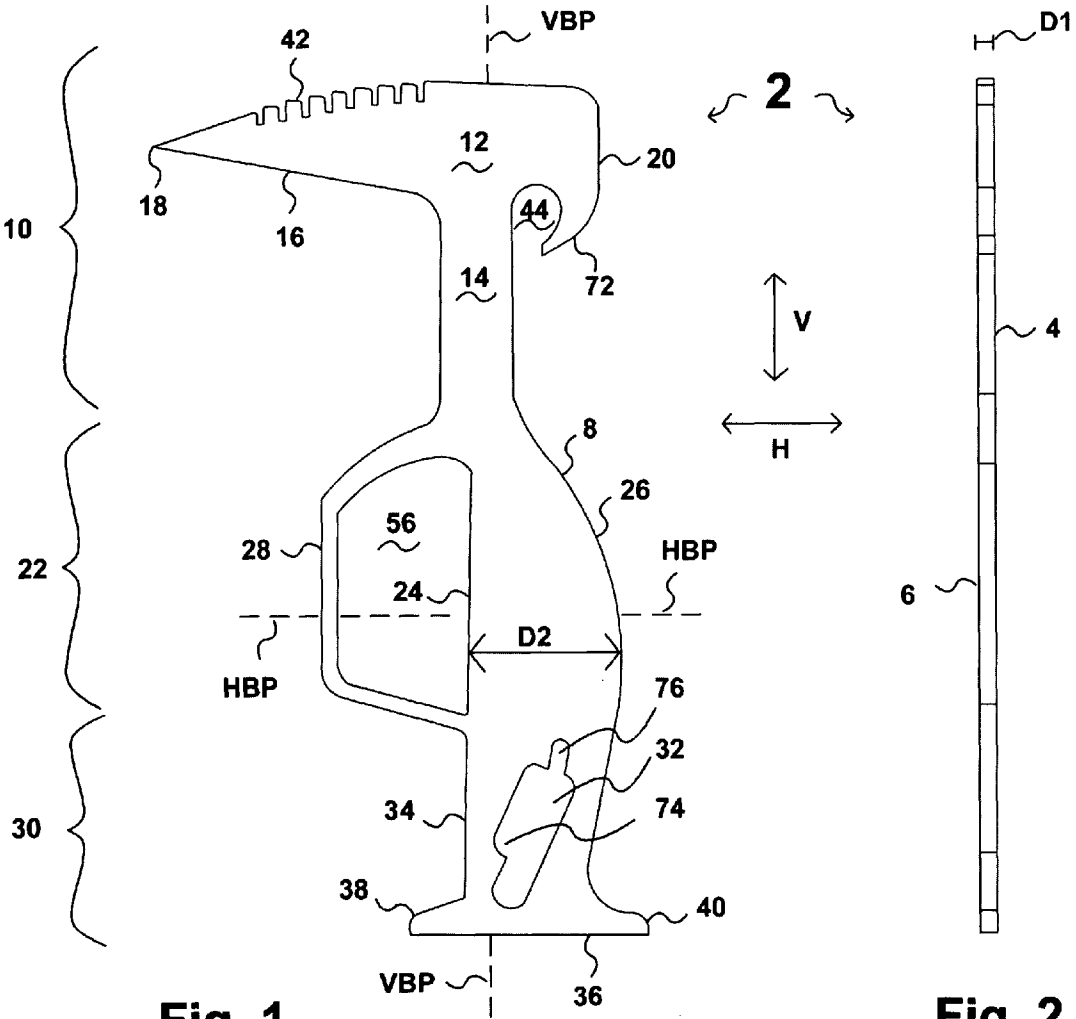
FIG. 1 is a left side elevation view of the invention.
FIG. 2 is a front elevation view of the invention.

FIGS. 1 and 2 show side and front elevation views of the inventive rescue tool 2. Referring to FIGS. 1 and 2, the tool 2 comprises a unitary metallic sheet member of a uniform diameter D1 having a top side 4, a bottom side 6, a vertical axis "V", a horizontal axis "H", and a continuous peripheral edge 8 defining a hook portion 10, a base portion 30, and a grip portion 22 between the hook 10 and base 30 portions.

The hook portion 10 comprises a head 12 having a first end 16 and a second end 20, and a neck 14 extending perpendicularly proximate the second end 20. The head 12 and neck 14 form a generally L-shaped hook portion 10. The first end 16 of the head 12 is generally tapered along the length of its axis to an acute tip 18. That portion of the peripheral edge 8 defining the acute tip 18 has the same uniform diameter D1.

The head 12 further comprises a plurality of pivot notches 42 formed into the peripheral edge 8 proximate the acute tip 18 and a spanner wrench opening 44. The pivot notches 42 provide added grip and traction when pivoting the head 12 and separating two elements as further discussed in connection with FIGS. 3A, 3B and 4.

Referring to FIGS. 1 and 2, the grip portion 22 includes a finger region 24 opposed to a palm region 26. The finger region 24 includes at least one opening 56 defined by a continuous generally U-shaped finger guard 28 extending along the horizontal axis "H" beneath the first end 16 of the head 12. The palm region 26 is defined by a generally convex curve extending along the horizontal axis at D2.

Figure 3B:
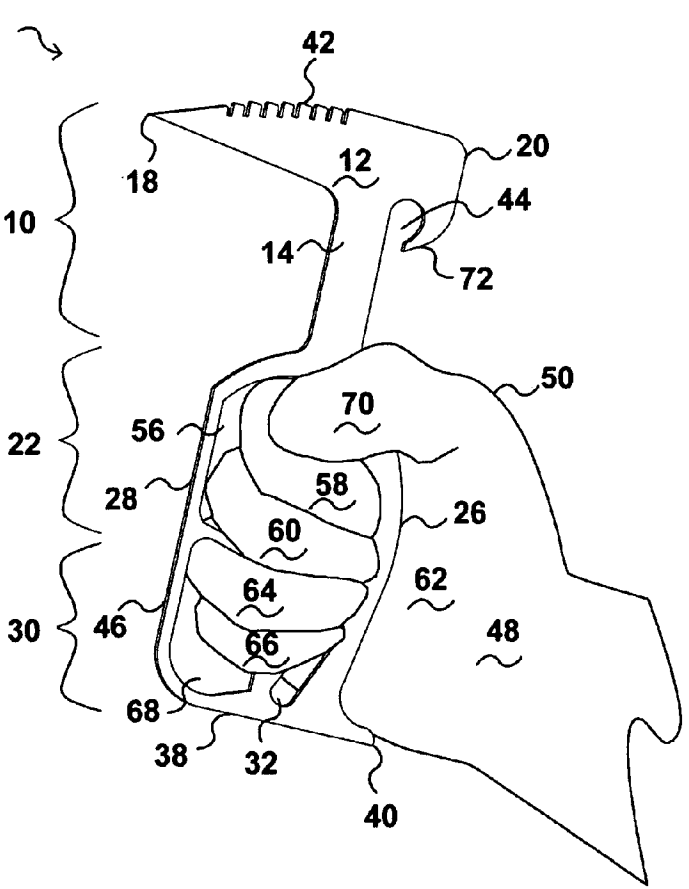
FIG. 3B is a perspective view of an alternate embodiment of the invention with dual finger guard being held by the gloved hand of a user in a striking and/or leverage creating position.
Figure 3A:
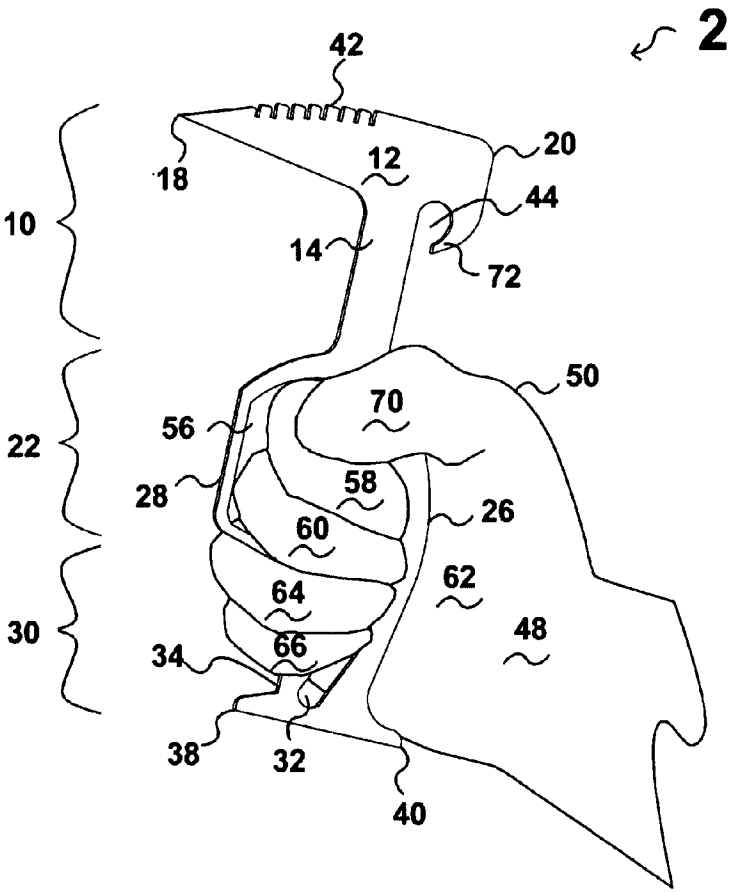
FIG. 3A is a perspective view of the invention with single finger guard being held by the gloved hand of a user in a striking and/or leverage creating position.

The base portion 30 comprises a lower finger grip region 34, an elongated aperture 32, and opposed left 38 and right 40 V-shaped flanges. The flanges 38, 40 give the base of the tool 2 a flared appearance. The flanges 38, 40 as shown in FIG. 1 are asymmetrical, with flange 40 having a more pronounced curve to correspond to the base of a user's palm as shown in FIGS. 3A and 3B. However, the flanges 38, 40 may be symmetrical and of any suitable or desired shape and length.

The unitary sheet member 2 is made from a metallic sheet material which can be plasma cut, stamped, or cut with a laser. Alternately, the tool 2 may be cast from iron or other molten metals or alloys. The preferred embodiment is constructed of 304 stainless steel and is plasma cut to form a unitary sheet of metal that is virtually indestructible.

Striking Applications

FIG. 3A shows the tool 2 being held by the gloved 48 hand of a user 50 in a striking or leverage creating position. Referring to FIG. 3A, the sheet member 2 comprises a grip portion 22 having a first finger region opening 56 and a palm region 26. The finger region opening 56 is shaped for insertion and gripping of the user's 50 index and middle fingers 58, 60 and is defined by a first finger guard 28. The palm region 26 is shaped for gripping by the user's 50 palm 62. The base portion 30 includes a lower finger grip region 34 shaped for gripping by the user's 50 ring and small fingers 64, 66. The base portion 30 further includes opposed V-shaped flanges 38, 40 extending laterally to prevent the fingers 64, 66 and/or palm 62 of the user's 50 hand from slipping off the base portion 30.

FIG. 3B shows an alternate embodiment of the tool 2 being held by the gloved 48 hand of a user 50 in a striking or leverage creating position. As shown in FIG. 3B, the alternate embodiment comprises a second generally U-shaped finger guard 46 extending from the first finger guard 28 to the V shaped flange 38 on the base portion 30. The second finger guard 46 defines a second opening 68 for insertion of one or more fingers for protection 64, 66. The second finger guard 46 protects any of the user's 50 fingers not protected by the first finger guard 28.

As shown in FIGS. 3A and 3B, the tool 2 is designed for secure retention by a gloved hand in a striking position, i.e., where the user desires to use the head 12 with acute tip 18 to perform a rescue related activity. The striking position as shown in FIGS. 3A and 3B can be used to swing the tool 2 downward to strike objects, such as car windows. The acute tip 18 combined with the durability of the all-stainless steel tool 2 and associated weight of the tool 2 as it is swung in a downward direction immediately fractures glass objects with little effort. The acute tip 18 also provides accurate placing of the strike on the glass with corresponding ability to predict where the glass will break. Accuracy in breaking glass is necessary when removing a window in a rescue scenario. The glass needs to be broken preferably away from the direction of the vehicle occupants who may be trapped within the vehicle. In addition, all of the glass needs to be removed through striking and raking the glass shards away and down to the ground to create an opening sufficient to remove the trapped occupants. The acute tip 18 of the present invention allows for accuracy in creating openings in the glass, whereas the head portion 10 can then be utilized to rake and scrape away the glass shards in a direction away from the vehicle occupants.

Referring to FIGS. 3A and 3B, the finger guards 28, 46, protect the user's 50 fingers 58, 60, 64, 66 as the tool 2 is being thrust in a downward direction to hit the desired object. In the case of glass, the momentum of the downward swing may cause the tool 2 to come into contact with the broken glass that has been pierced by the acute tip 18. The guards 28, 46 come into contact with the broken glass and further act to break the glass in a full downward thrust scenario. Consequently, the guards 28, 46 both protect the user's 50 hand from injury and simultaneously speed up the process of breaking and clearing the glass in extreme response situations where time is of the essence.

The striking position also may be used to swing the tool 2 in an upward direction. Responders often are required to break into buildings as part of their attempts to save property and lives. At other times, responders are in need of getting equipment inside a building that may have limited access. As a result, responders sometimes need to remove one or more doors from a building or residence. Referring to FIGS. 3A and 3B, a user 50 may use the tool 2 in the striking position to remove pins from hinged doors by swinging in an upward direction and having the acute tip 18 contact the face of the hinge pin to loosen it and move it in an upward direction to free the hinge and allow for full removal of a door.

Referring to FIGS. 1, 3A and 3B, given the all-metal structure of the tool 2 with resulting strong force of blow when using the tool 2 in the striking position, both male and female responders may effectively use the tool 2 in multiple emergency response settings. The tool 2 may be held comfortably in the striking position by a responder having a smaller sized hand (such as a female responder) by inserting three fingers (index, middle and ring fingers 58, 60, 64) within the first finger region opening 56 defined by the first finger guard 28. In addition, the tool 2 does not require significant strength for use as a striking tool 2 due to the powerful blow created by a solid metal tool.

Peeling Applications

The head 12 with acute tip 18 may alternately be used for more precise functions that do not require power or thrust. In particular, the same striking position as shown in FIGS. 3A and 3B may be used to gently pull material aside for viewing of objects underneath the material. This use is extremely important in revealing the location of pressurized gas cylinders in a vehicle rescue scenario. The cylinders are concealed within vehicle linings which are often disrupted during accidents. If the cylinder is punctured, the cylinder may explode and fragment. Consequently, the emergency responders must carefully look for and visually locate the cylinder without the use of power tools to avoid puncturing the cylinder.

Referring to FIGS. 3A and 3B, the striking position may be used to slip the acute tip 18 of the head 12 under and behind linings and pull to move and/or rip the linings to reveal the cylinder's location. The tapered head 12 and hook portion 10 of the tool 2 allow a user 50 to precisely insert the acute tip 18 and choose the material/lining that the user 50 wants to move or tear. Once a user 50 has determined that only lining/material is hooked within the hook portion 10, the user 50 may pull on the tool 2. The all-metal structure of the tool 2 provides the user 50 with significant power to stretch, move, and/or tear the material. The added pulling pressure provided by the all-metal tool 2 speeds the process of removing any lining that is concealing the air bag cylinder. As with all rescue efforts, the less time required to remove the material/lining and visually locate the airbag cylinder, the better the chance of rescuing the vehicle's occupants in a safe and effective manner.

Screw Driver Application

Referring to FIGS. 1, 3A and 3B, the acute tip 18 of the tool 2 may further be utilized to loosen screws in the same manner as a screw driver. A user 50 may hold the tool 2 in the striking position, insert the acute tip 18 into the slot opening of a screw head, and twist the tool to loosen the screw. The preferred diameter of the tool is 0.25 inches, thereby forming an acute tip 18 having the width of a typical screw driver. The metal acute tip 18 has the strength of a typical screw driver, with added leverage capable through twisting of the large grip portion 22 of the tool 2.

Hammer Applications

Referring to FIG. 1, the second end 20 of the head 12 may further be utilized in the manner of a hammer to strike at objects. In that event, a user 50 reverses the hand position as shown in FIGS. 3A and 3B. The user 50 inserts the user's thumb 70 through the first finger region opening 56 and curls his/her other fingers (58, 60, 64, 66) around the curved palm region 26 ("Hammer Position"). Then, while maintaining the Hammer Position, a user 50 rotates his/her wrist and/or forearm to strike an object with the flat peripheral edge of the second end 20 of the head 12. Likewise, a user 50 may hold the tool in the Striking Position (shown in FIGS. 3A and 3B) and hit an object with the flat surface of the head 12 by repeatedly rotating the user's wrist in a sideways direction.

Pry Bar Applications

Due to the all-metal structure of the tool 2, the head 12 and acute tip 18, even though tapered for fine motor control functions, may also serve as a strong pry bar to force other objects, including metal structures, apart during rescue operations.

Referring to FIGS. 3A and 3B, the striking position may be used to create leverage to pry solid objects apart by inserting the acute tip 18 between two objects to be separated and pulling the tool 2 in a perpendicular direction.

Figure 4:
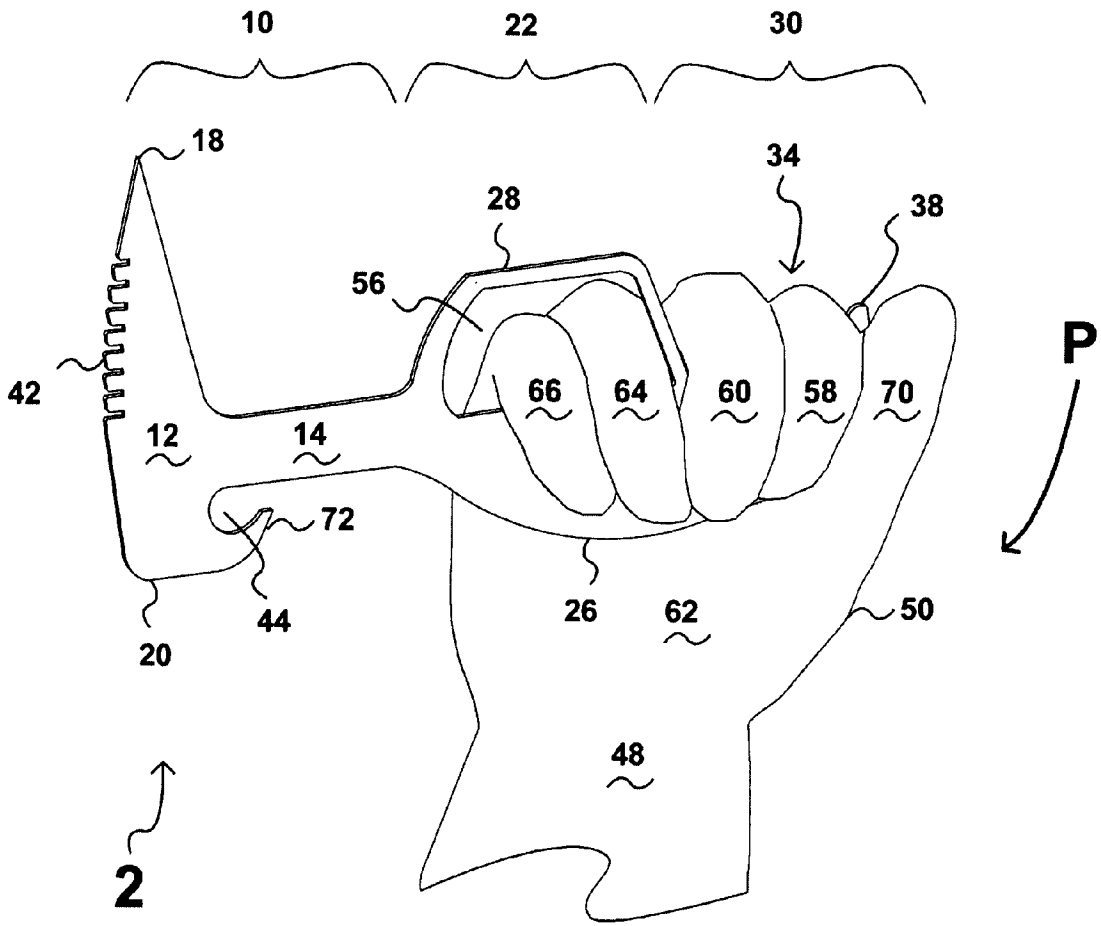
FIG. 4 is a perspective view of the invention being held by the gloved hand of a user for creating leverage with the head portion.

FIG. 4 shows an alternate manner of holding the tool 2 for creating leverage with the hook portion 10. As shown in FIG. 4, the tool 2 may be held with the ring and small fingers 64, 66 inserted through the first finger opening 56 of the first finger guard 28, with the index and middle fingers 58, 60 wrapped around the lower finger grip region 34. In the alternate embodiment shown in FIG. 3B, the index and middle fingers 58, 60 would be inserted through the second finger opening 68 formed by the second finger guard 46.

Referring to FIG. 4, in a pry bar scenario, a user 50 inserts the acute tip 18 and head 12 between objects and pulls in direction "P" in the fashion of a pry bar. The grip portion 22 and base portions 30 of the tool 2 provide ergonomic control to the pry bar action by providing, inter alia, an outwardly curved palm region 26 that fits within the user's 50 palm 62, and V-shaped flanges 38, 40 (shown in FIG. 1) that conform to the curves created by the fisted hand around the base portion 30. In addition, the user's 50 hand grips the tool 2 at the furthest point away from the head 12 and acute tip 18, thereby providing a maximum length fulcrum for maximum power when pulling the tool 2 in pry bar fashion.

Spanner Wrench Applications

Referring to FIGS. 1, 3A and 4, the inventive tool 2 further comprises a spanner wrench opening 44 formed within the second end 20 of the head 12. The spanner wrench opening 44 is defined by a tapered curve ending in an acute tip 72. Spanner wrenches are used by emergency responders, primarily firefighters, to loosen and tighten fire hose couplings. Couplings are threaded metallic rings used to connect lengths of hose together, to connect a hose to a fire hydrant, or connect a hose to valves on the fire engines. The outside surface of the tubular couplings comprises a series of outwardly extending metallic rocker lugs or rocker pins. Spanner wrenches are hooked around the rocker lugs for tightening or loosening the connection of the coupling to the other coupling, the hydrant and/or valve.

Referring to FIGS. 1, 3A and 4, when holding the tool 2 in the striking position as shown in FIG. 3A, the spanner wrench opening 44 can be selectively inserted over and around a rocker lug on a coupling (not shown). Once slidably inserted around the lug, the user 50 pulls on the grip and base portions 22, 30 to generate torque pressure on the rocker lug to loosen or tighten the coupling as desired. FIG. 4 shows an alternate hand position of the user 50 to create torque on a lug within the spanner wrench 44 depending on the position of the user 50 relative to the lug and/or the amount of torque needed to loosen or tighten the coupling. The hand positions shown in FIGS. 3A and 4 are exemplary, only. Multiple hand positions are possible using the tool 2 to achieve pry bar and spanner wrench applications.

Referring to FIGS. 3A and 3B, the acute tip of the spanner wrench 72 may further be used to expose pressurized gas cylinders. Using the acute tip 72, a user selectively inserts vehicle liner and material into the spanner opening 44. By pulling the tool 2, the user removes the material to safely expose the location of the pressurized gas cylinder.

Due to the specified positions of the acute tip 18, second end 20 and spanner wrench 44/72, a responder may perform a sequence of multiple response-related activities without having to adjust the responder's hand position from the striking position shown in FIGS. 3A and 3B. For example, while maintaining the striking position, a responder may break a vehicle window using the acute tip 18 and/or the hammer head 20, remove the window shards with the hook portion 10, reach into the vehicle interior to remove lining using the hook portion 10 and/or spanner wrench 72/44, and tighten or loosen a hose connection using the spanner wrench 44/72. Tightening or loosening hose couplings requires a sharp tap (using the acute tip 18) followed by the use of the spanner hook 44/72 to tighten or loosen the coupling. The inventive tool 2 incorporates in one hook portion 10 everything the responder needs to perform these multiple tasks without having to change grip on the tool 2.

Natural Gas Shut-off and Valve Stem Removal Applications

Emergency responders are required, wherever feasible, to shut off natural gas lines to buildings, homes, heating systems, gas stoves, and the like, as part of their response efforts. The gas lines are fed and controlled by valve stems. Quick and efficient turning off of the gas lines via turning of the valve stems is essential to preventing major fires and resulting property damage.

Figure 5:
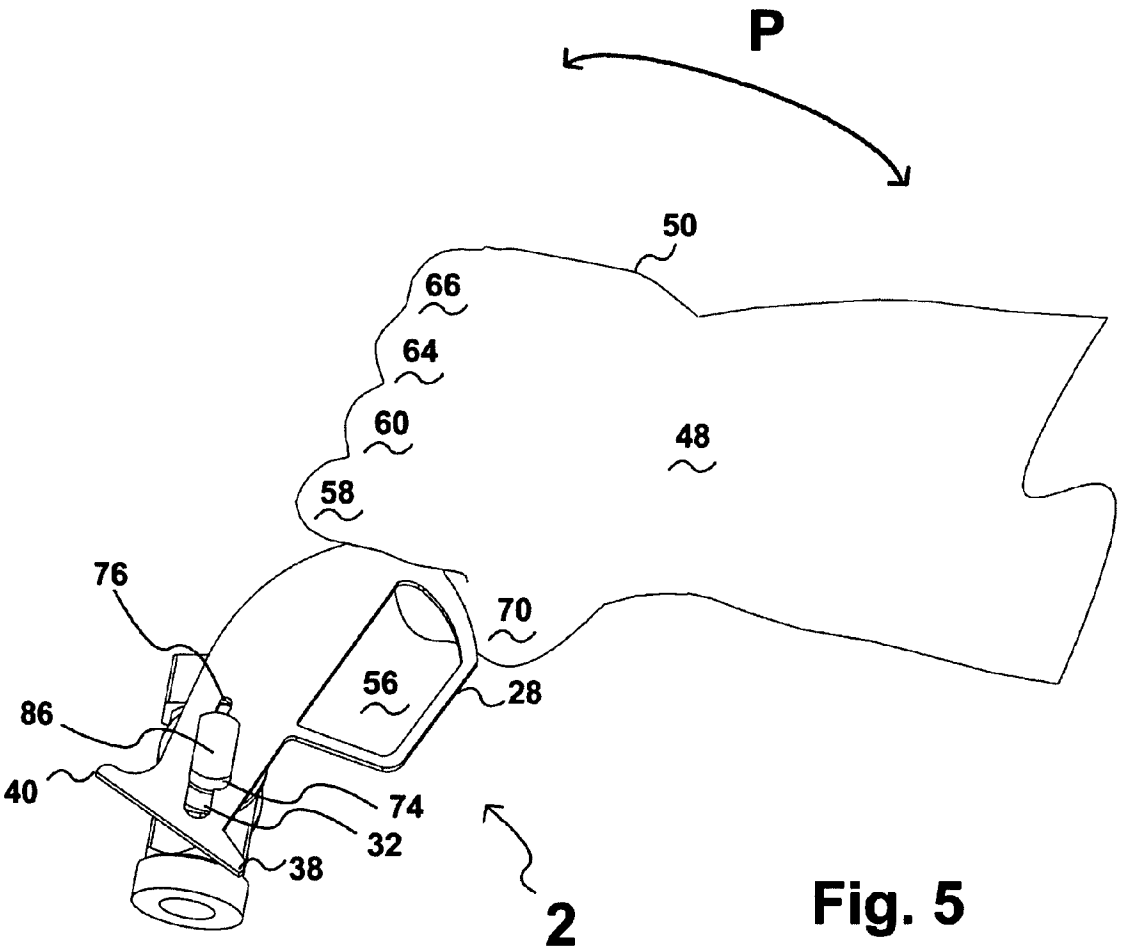
FIG. 5 is a perspective view of the invention being held by the gloved hand of a user for creating leverage with the base portion.

Referring to FIGS. 1 and 5, the tool 2 comprises a generally elongated aperture 32 shaped for slidable and secure insertion over and around a plurality of valve stems of defined shapes, an exemplary shape 86 of which is shown in FIG. 5. The shape of valve stems on natural gas systems varies from state to state. The aperture 32 of the present tool 2 includes an indentation 74 that allows the aperture 32 to be used universally on valve stems of different shapes as required by different jurisdictions. In addition, the aperture 32 includes an oxygen tank indentation 76 for use in turning oxygen tank valves on and off. The oxygen tanks are used by the emergency responders to provide medical care to patients, including providing oxygen to fire victims.

In use, referring to FIG. 5, a user 50 inserts the aperture 32 over and around the valve stem 86 and grasps the neck 14 of the tool 2 before pushing or pulling the tool 2 to apply torque pressure on the valve 86 in an effort to close the valve 86. Conversely, if the responder desires to re-open the valve 86, the aperture 32 is slidably inserted around the valve stem with pressure applied in the opposite direction to re-open the valve 86.

Referring to FIGS. 1 and 5, the aperture 32 may further be used to stabilize a vehicle during response efforts. In an accident scene, the vehicle may have become destabilized, for example, by having slid off the road onto an incline. In those circumstances, there is a risk of injury to the occupants during extrication if the vehicle starts to move. To stabilize vehicles, responders often flatten tires before removing the accident victims. The acute tip 18 of the inventive tool 2 may be used to remove the hub cap of a wheel, after which a responder slidably inserts the aperture 32 over and around the tire's valve stem. The tool 2 is then twisted to break the stem off, thereby causing the tire to deflate. Once the vehicle frame is on cribbing, blocks, or the rims, the vehicle is more stable. Alternately, the acute tip 18 may be driven into a tire's sidewall for immediate tire deflation.

Cutter Applications

Figure 6A:
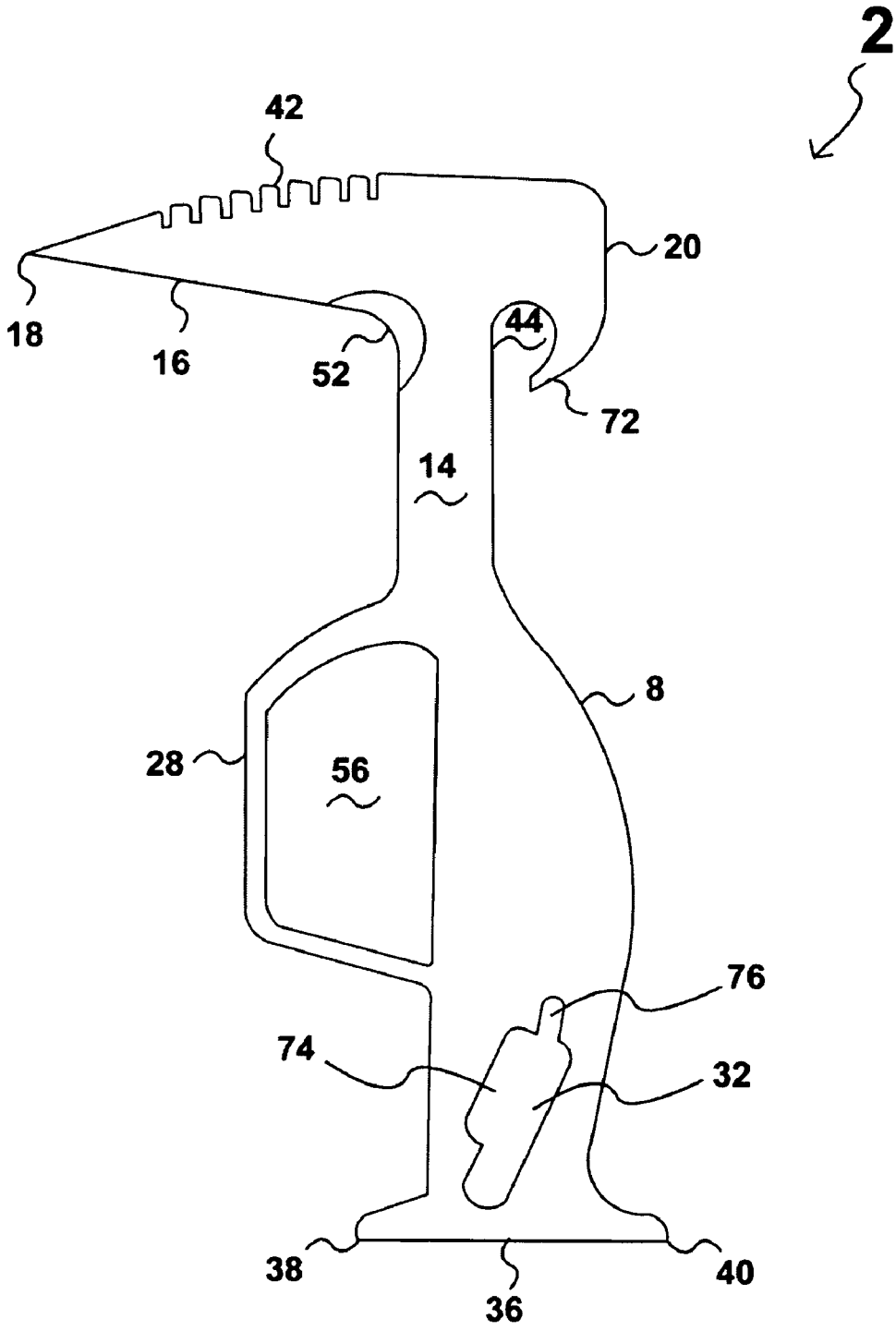
FIG. 6A is a left side elevation view of an alternate embodiment of the invention with beveled cutter; and, FIGS. 6B and 6C are partial enlarged perspective views of an alternate embodiment of the invention comprising an internalized cutter with metal blade.
Figure 6B:
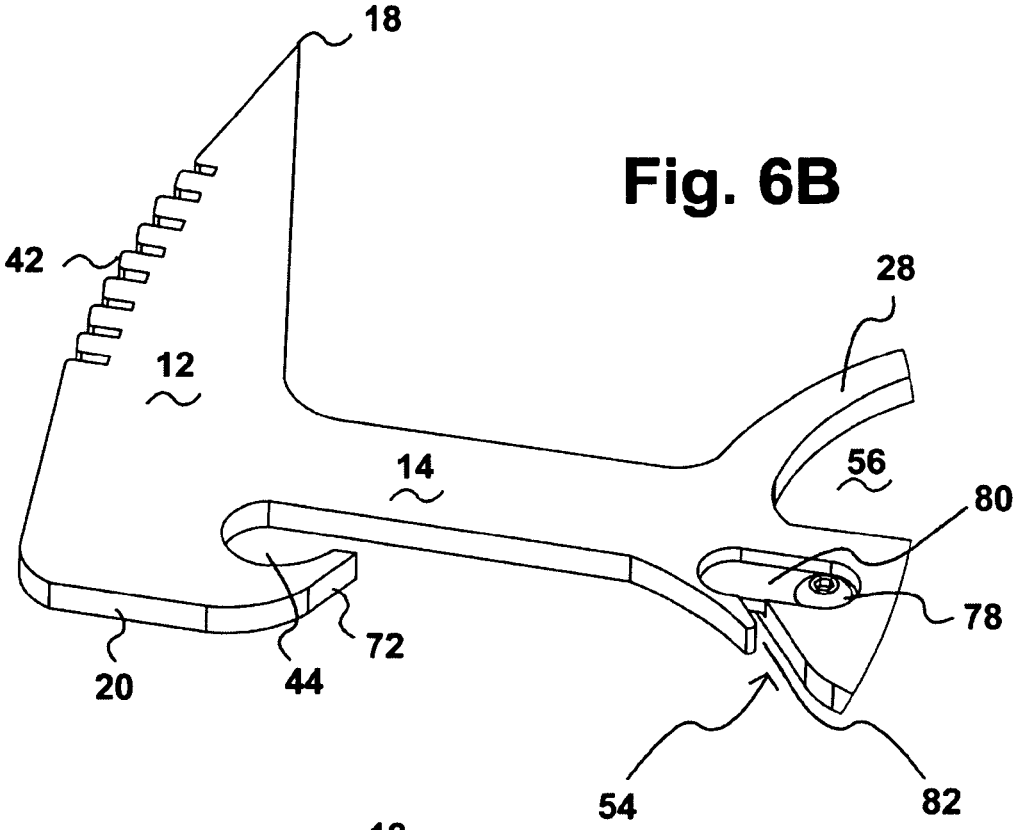
Figure 6C:
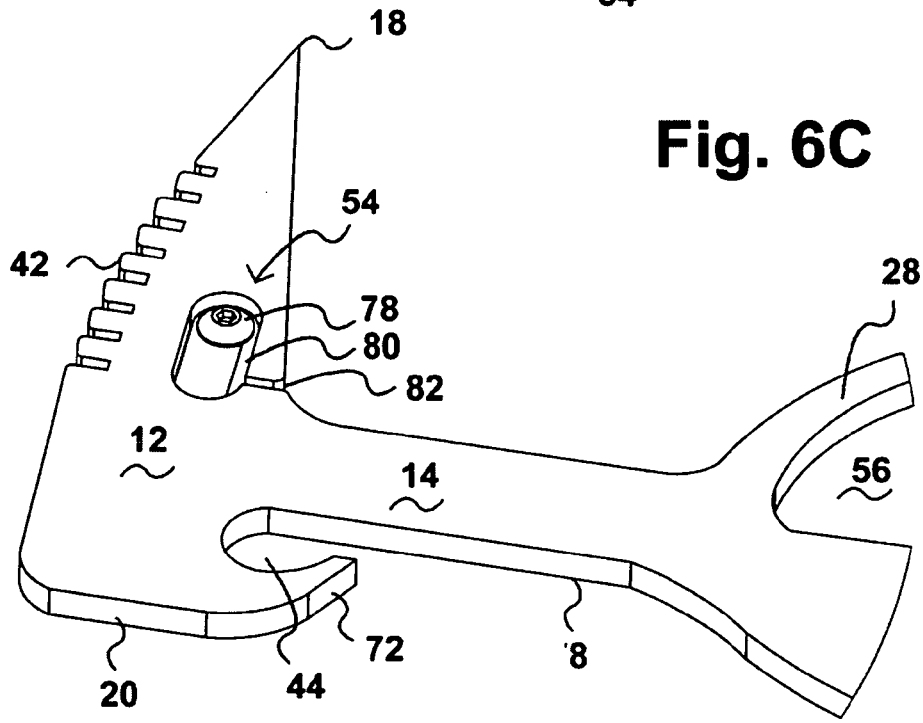

Referring to FIGS. 6A-6C, an alternate embodiment of the tool 2 further comprises a cutter 52, 54 for cutting lining or other material during rescue operations. A first embodiment of the cutter is shown in FIG. 6A. Referring to FIG. 6A, the first cutter 52 comprises a beveled and tapered semi-circular depression formed within the peripheral edge 8 at the curved juncture between the head 12 and neck 14. The cutter 52 is used by the responder to cut car seat straps and/or other linings and material in the course of response efforts. A user 50 positions the cutter 52 proximate the material and pushes or pulls the tool 2 to cut the material. Alternately, where thick material is involved, a user 50 may hold the material and move the tool 2 and cutter 52 in a back and forth direction to saw at the material in the course of cutting the material.

FIGS. 6B and 6C show a second cutter embodiment wherein the tool 2 comprises an internalized cutter 54 either at the base of the neck 14 (FIG. 6B) or within the head 12 (FIG. 6C). Referring to FIGS. 6B and 6C, the internalized cutter 54 comprises a sharpened blade 80 affixed by a screw 78 within an oval-shaped aperture formed within the body of the tool 2. In use, material is slidably inserted within the slot opening 82 for contact with the sharpened edge of the blade 80 for cutting the material. The narrow slot opening 82 protects the user's hands from coming into contact with the sharp edge of the blade 80. As shown in FIGS. 6B and 6C, the internalized cutter 54 may be formed at the base of the neck 14, within the head 12, or at any suitable or desired position along the peripheral edge 8 of the tool 2.

Weight Distribution

Referring to FIGS. 1-6C, the multiple applications of the tool 2 are feasible due to strategic weight distribution of tool 2 features along the vertical ("V") and horizontal ("H") axes.

The weight of the tool 2 (approximately 16 oz.) is balanced substantially around its center points, thereby rendering the tool 2 comfortable and effective to use. In FIG. 1, the approximate center of balance along the horizontal axis is shown and labeled "HBP" (horizontal balance point). The approximate center of balance along the vertical axis is shown and labeled "VBP" (vertical balance point). The balanced nature of the tool 2 permits effective use of the various functions from one end of the tool 2 to the other. Both the weight (approximately 1 pound) and the balanced nature of the tool 2 further render it easy to carry and manipulate by both male and female users.

The even weight distribution assists the user in the leverage applications discussed above, including the pry bar applications, the spanner wrench applications, and the valve stem applications, by providing a tool 2 that is inclined to be retained at level position when applying leverage to the pry point, a lug on a coupling, or a valve stem.

Storage and Transport

The preferred maximum horizontal dimension (width) of the tool 2 is 5 inches; the preferred maximum vertical dimension (length) is 9 inches. The preferred depth (D1) of the tool 2 is 0.25 inches. The preferred length, width and uniform depth form a tool 2 that slides into and fits within a standard sized pocket of a responder's Personal Protective Equipment (PPE), commonly referred to as a firefighter's "turnouts". Turnouts are protective jackets and pants with large pockets. The tool 2 as designed has a weight of approximately 1 pound and slides easily into the turnout pockets due to its metallic construction, smooth sides 4, 6, and smooth peripheral edge 8. The tool 2 does not extend out of the pocket, and the tool 2 is thin (preferably ¼ inch wide) flat and smooth. Given the tool's 2 even weight distribution, the tool is retained in a generally flat position (along the vertical plane) within the pocket without causing a bulge or feeling top-heavy. As a result, the tool 2 does not interfere with the movement or actions of the responder and is accessible at all times because it is easily carried on the responder's body.

In addition, the tool 2 is designed for use by a gloved hand of a user. When reaching into the pocket, a gloved hand can easily find and pull out the tool given its all-metal structure with hook portion 10 on one end, and V-shaped flanges 38, 40 on the base portion 30. In addition, the finger guard 28 defines a sufficiently large opening 56 to permit quick and unfettered insertion of two large gloved fingers.

Advantages Relating to Emergency Scenarios

The all-metallic tool 2 of the present invention has no moving (hinged) parts or any subparts that can break or require time to adjust prior to use. The tool 2 is constructed in a manner that renders it sufficiently strong for the task at hand. The tool 2 is universally designed for use by both male and female responders regardless of hand size or strength. The tool 2 is capable of fine motor controlled use such as in pulling material lining away from a vehicle frame to expose the pressurized gas cylinders.

The tool 2 has a weight distribution that serves one or more functions such as striking and breaking otherwise intact car windows. The tool 2 has multipurpose features beyond accident victim extrication including connecting fire hoses, turning gas valves of varying sizes/designs off to prevent fire, or turning oxygen tank valves for emergency responder inhalation systems. The tool 2 is durable and can withstand exposure to high heat, hazardous or corrosive liquids. The tool 2 can be easily and comfortably carried and accessed by the emergency responder as he/she moves quickly in and around the accident site. The tool 2 provides finger protection to the user. The tool 2 is designed to provide maximum leverage for when maximum leverage is required to save a life.

Alternate Embodiments

It should be understood that various modifications within the scope of this invention can be made by one of ordinary skill in the art without departing from the spirit, thereof and without undue experimentation. For example, any suitable or desired metallic material may be used to form the tool, and it may be welded, soldered, die cast and/or plasma cut. In addition, any suitable or desired number and/or shape of notches on the head may be utilized; any suitable or desired size of spanner wrench may be utilized; and, any suitable or desired shape of aperture for application to multiple valve stem designs may be utilized. This invention is therefore to be defined as broadly as the prior art will permit, and in view of the specification if need be, including a full range of current and future equivalents thereof.

We claim:

1. A hand tool, comprising:

a unitary metallic sheet member of a uniform diameter having a top side, a bottom side, a vertical axis, a horizontal axis, and a continuous peripheral edge defining a hook portion at a distal end, a base portion at a proximal end, and a grip portion between the hook and base portions;

said hook portion comprising a head and a neck shaped to form a generally L-shaped hook portion;

a first end of said head having a generally tapered axis to an acute tip with a plurality of pivot notches formed in the peripheral edge proximate the acute tip;

a second, opposed end of said head comprising a generally rectangular peripheral edge defining, at a base of said end, a curved spanner wrench opening;

said grip portion including a finger region opposed to a palm region, said finger region including at least one opening defined by a continuous generally U-shaped first finger guard extending along the horizontal axis beneath the first end of the head;

said palm region defined by a generally convex curve extending along the horizontal axis;

said base portion including an elongated aperture defined within the unitary sheet member, a lower finger grip region, and a proximal end having opposed left and right V-shaped flanges extending laterally therefrom.

2. The hand tool of claim 1 wherein the spanner wrench opening is shaped for selective insertion over and around a rocker lug on a coupling.

3. The hand tool of claim 1 wherein that portion of the peripheral edge forming the second end of the head is shaped for striking objects in the manner of a hammer.

4. The hand tool of claim 1 wherein the acute tip is shaped for slidable insertion within a slot opening of a screw head.

5. The hand tool of claim 1 wherein the finger region opening is shaped for insertion of at least two gloved fingers of a user.

6. The hand tool of claim 1 wherein the finger region further includes a second opening defined by a continuous generally U-shaped second finger guard extending along the horizontal axis beneath the first end of the head, a base of said second finger guard connected to the left flange of the base portion.

7. The hand tool of claim 1 wherein the aperture in the base portion is formed to permit slidable insertion therein of a plurality of valve stems of defined shapes.

8. The hand tool of claim 1 further comprising a first cutter, said first cutter comprising a beveled semi-circular depression formed within the peripheral edge.

9. The hand tool of claim 1 further comprising a second cutter, said second cutter comprising a sharpened blade affixed within a blade aperture formed within the body of the tool, said aperture further comprising a slot opening to the peripheral edge of the tool.

10. The hand tool of claim 1 wherein the peripheral edge is shaped to have a maximum vertical dimension of the tool along the vertical axis and a maximum lateral dimension of the tool along the horizontal axis to permit insertion and retention of the tool within a turnout coat pocket.

11. The hand tool of claim 1 wherein a weight distribution of the unitary metallic sheet member is generally balanced along the vertical and horizontal axes.

12. The hand tool of claim 1 wherein a user applies the tool in an application selected from the group consisting of: striking, peeling, screw driver, hammer, pry bar, spanner wrench, valve stem, cutting.

13. The hand tool of claim 1 wherein the sheet member is constructed of 304 stainless steel metal.

14. The hand tool of claim 1 wherein the uniform diameter is 0.25 inches.

* * * * *